US008161873B2

(12) United States Patent
Yamasaki

(10) Patent No.: US 8,161,873 B2
(45) Date of Patent: Apr. 24, 2012

(54) SERVO PRESS AND OPERATING METHOD THEREOF

(75) Inventor: Shusaku Yamasaki, Tokyo (JP)

(73) Assignee: IHI Corporation, Tokyo (JP)

( * ) Notice: Subject to any disclaimer, the term of this patent is extended or adjusted under 35 U.S.C. 154(b) by 380 days.

(21) Appl. No.: 12/377,805

(22) PCT Filed: Jul. 23, 2007

(86) PCT No.: PCT/JP2007/064399

§ 371 (c)(1),
(2), (4) Date: Feb. 17, 2009

(87) PCT Pub. No.: WO2008/020525

PCT Pub. Date: Feb. 21, 2008

(65) Prior Publication Data

US 2010/0282098 A1 Nov. 11, 2010

(30) Foreign Application Priority Data

Aug. 14, 2006 (JP) ..... 2006-221148

(51) Int. Cl.
*B30B 1/10* (2006.01)
*B30B 1/18* (2006.01)

(52) U.S. Cl. ..... 100/287; 100/283

(58) Field of Classification Search ..... 100/35, 100/272, 280, 281, 283, 285, 286, 287, 289; 72/450, 451, 456
See application file for complete search history.

(56) References Cited

U.S. PATENT DOCUMENTS 264,219 A * 9/1882 Bankston ..... 100/244
1,353,252 A * 9/1920 Littig ..... 318/267
2,087,811 A * 7/1937 Patrick ..... 100/272
5,832,816 A 11/1998 Seto et al.
6,041,699 A 3/2000 Seto et al.
6,053,724 A * 4/2000 Eppich ..... 425/593
6,200,122 B1 * 3/2001 Chun et al. ..... 425/136
7,510,389 B2 * 3/2009 Schroder ..... 425/451.4
2006/0156933 A1 * 7/2006 Hofele et al. ..... 100/281

FOREIGN PATENT DOCUMENTS

JP 04-100697 4/1992

(Continued)

OTHER PUBLICATIONS

International Search Report issued in corresponding International Application No. PCT/JP2007/064399, completed Aug. 21, 2007 and mailed Sep. 4, 2007.

(Continued)

*Primary Examiner* — Jimmy T Nguyen

(74) *Attorney, Agent, or Firm* — Griffin & Szipl, P.C.

(57) ABSTRACT

The invention provides a servo press which can obtain a higher speed in a moving section of a slide, and a higher pressure in a pressurizing section near a bottom dead point without enlarging a capacity of a motor. The servo press is provided with a multi-toggle mechanism 10 moving up and down a slide 5 in which an upper die is to be fixed to a lower surface of the slide, and a toggle driving mechanism 20 provided on a crown 6 located to an upper side of the slide and driving the multi-toggle mechanism. The multi-toggle mechanism 20 is structured such as to include three or more toggles generating a force amplifying effect by a plurality of links 11, 12, 13, 14.

6 Claims, 8 Drawing Sheets

FOREIGN PATENT DOCUMENTS

| | | | |
|---|---|---|---|
| JP | 09-192890 | | 7/1997 |
| JP | 10-109192 | | 4/1998 |
| JP | 10-000113 | | 5/1998 |
| JP | 10-249590 | | 9/1998 |
| JP | 2001-150190 | | 6/2001 |
| JP | 2001-300778 | | 10/2001 |
| JP | 2001300778 | A | 10/2001 |
| JP | 2002-103089 | | 4/2002 |
| JP | 2003-290984 | | 10/2003 |
| JP | 2004-009066 | | 1/2004 |
| SU | 1442427 | A1 | 12/1988 |

OTHER PUBLICATIONS

Office Action issued in corresponding Taiwan Patent Application No. 96128961, mailed Oct. 15, 2010 and its Japanese translation.

Office Action issued in Russian Application No. 20091029245 dated Aug. 2, 2010.

Office Action issued on Dec. 27, 2011 in corresponding Korean Application No. 10-2009-7002786.

* cited by examiner

SERVO PRESS AND OPERATING METHOD THEREOF

This is a National Phase Application in the United States of International Patent Application No. PCT/JP2007/064399 filed Jul. 23, 2007, which claims priority on Japanese Patent Application No. 221148/2006, filed Aug. 14, 2006. The entire disclosures of the above patent applications are hereby incorporated by reference.

BACKGROUND OF THE INVENTION

1. Field of the Invention

The present invention relates to a servo press moving up and down a slide by a toggle mechanism and an operating method thereof.

2. Description of the Related Art

Conventionally, there has been known a servo press having a toggle mechanism (also called as a knuckle mechanism). The toggle mechanism converts a linear motion taken out by converting a rotation of a servo motor, into an upward and downward motion of a slide.

Generally, the toggle mechanism is provided with a first link and a second link in which one ends thereof are rotatably connected to each other in a connecting point, the other end of the first link is rotatably connected to a part of a crown, the other end of the second link is rotatably connected to the slide, and a driving link is rotatably connected to the connecting point between the first link and the second link.

In the toggle mechanism having the structure mentioned above, since a toggle shape constructed by the first link and the second link is deformed so as to open and close by moving forward and backward the driving link with respect to the first and second links by a direct acting actuator, the slide is moved up and down. Since it is possible to make a sliding speed near a bottom dead point slower in comparison with a crank mechanism by having the toggle mechanism mentioned above, it is possible to satisfy a demand in each of a moving section (high speed and low pressure) and a pressurizing section (low speed and high pressure).

Above described servo presses having the toggle mechanism are disclosed in Japanese Unexamined Patent Publication No. 2002-103089 and Japanese Unexamined Patent Publication No. 2001-300778.

A servo press in Japanese Unexamined Patent Publication No. 2002-103089 is structured such as to drive a toggle driving means having a ball screw by a servo motor, and drive a toggle mechanism (called as a knuckle mechanism in Japanese Unexamined Patent Publication No. 2002-103089) constituted by two links connected by a connecting pin by the toggle driving means, thereby moving up and down a slide via a plunger by bending and stretching motion of the toggle mechanism. The toggle mechanism of the servo press is constituted by a so-called one-stage toggle in which one toggle effect (a force amplification effect) can be obtained.

A servo press in Japanese Unexamined Patent Publication No. 2001-300778 is provided with a square multi-thread rotationally driven around an axis in a vertical direction, an elevating body engaging with the square multi-thread and being movable up and down together with a rotation of the thread, and a multi-link mechanism connecting between the elevating body and a slide. The multi-link mechanism has a pair of first links in which respective one ends are rotatably connected to right and left sides of the square multi-thread, a pair of right and left second links in which respective one ends are rotatably connected to a press frame, and a pair of right and left third links in which respective one ends are rotatably connected to a slide, and the other ends of the right and left first to third links are rotatably connected to each other. The slide is moved up and down via the elevating body and the multi-link mechanism by rotating the square multi-thread. The toggle mechanism of the servo press is constituted by a so-called two-stage toggle in which two toggle effects can be obtained.

The servo press of Japanese Unexamined Patent Publication No. 2002-103089 mentioned above employs the one-stage toggle, and the servo press of Japanese Unexamined Patent Publication No. 2001-300778 employs the two-stage toggle. Accordingly, it is possible to obtain a high speed in the moving section of the slide, and obtain a low speed and a high pressure in the pressurizing section.

However, in these servo presses, in order to obtain the higher speed in the moving section of the slide, and obtain the higher pressure in the pressurizing section near the bottom dead point, it is necessary to enlarge a capacity of the motor. Accordingly, there is a problem that the motor is enlarged in size and a cost is increased.

Further, in the servo press of Japanese Unexamined Patent Publication No. 2002-103089, the direct acting portion (the toggle mechanism) is arranged at a height corresponding to an intermediate position of the toggle mechanism. Accordingly, it is necessary to interpose a plunger (an extension link) between the slide and the direct acting portion so as to prevent the direct acting portion and the slide from being interfered with each other at a time when the slide is moved up, that is, so as to secure a stroke. The plunger mentioned above is essentially an unnecessary element in a mechanism for driving the slide. In other words, there is a problem that the essentially unnecessary element is included.

Further, in the servo press of Japanese Unexamined Patent Publication No. 2001-300778, since the square multi-thread is vertically arranged, a total height of the apparatus becomes high. In the press machine, it is required to secure a fixed stroke or more while suppressing the total height of the apparatus, however, in the servo press of Japanese Unexamined Patent Publication No. 2001-300778, there is a problem that it is hard to satisfy such a request.

SUMMARY OF THE INVENTION

The present invention is made by taking the circumstance mentioned above into consideration, and an object of the present invention is to provide a servo press which can obtain a higher speed in a moving section of a slide, and a higher pressure in a pressurizing section near a bottom dead point without enlarging a capacity of a motor. Further, an object of the present invention is to provide a servo press in which it is not necessary to interpose a plunger between a toggle mechanism and a slide. Further, an object of the present invention is to provide a servo press that can suppress a total height of an apparatus. Further, an object of the present invention is to provide an operating method of the servo press mentioned above.

In order to solve these problems mentioned above, the servo press in accordance with the present invention employs the following means.

(1) In other words, the servo press in accordance with the present invention is provided with a multi-toggle mechanism moving up and down a slide in which an upper die is to be fixed to a lower surface thereof, and a toggle driving mechanism provided on a crown located to an upper side of the slide and driving the multi-toggle mechanism, the multi-toggle mechanism is structured such as to include three or more toggles generating a force amplifying effect by a plurality of links.

In accordance with the servo press on the basis of the present invention, since there is employed the multi-toggle mechanism structured such as to include three or more toggles generating the force amplifying effect, that is, a three-stage toggle obtaining a three-stage toggle effect in the embodiment, by a plurality of links, a slide moving speed in a side closer to a top dead point than the portion near the bottom dead point is higher in comparison with the conventional one-stage toggle or the two-stage toggle, and the lower speed and the higher pressure are obtained near the bottom dead point, as shown in FIGS. 8 and 9. In this case, FIGS. 8 and 9 compare the servo press in accordance with the present invention having the three-stage toggle, with the conventional servo press having the one-stage toggle or the two-stage toggle on the assumption that a motor work load is fixed.

Accordingly, it is possible to obtain a higher speed in the moving section of the slide and obtain a higher pressure in the pressurizing section near the bottom dead point without enlarging the capacity of the motor, and it is possible to prevent the motor from being enlarged in size and the cost from being increased. Alternatively, since it is possible to make the capacity of the motor small in the case of maintaining the same pressure as the conventional one, it is possible to achieve a downsizing of the motor and a cost reduction.

(2) Further, in the servo press of the item (1) mentioned above, the multi-toggle mechanism has a first link and a second link rotatably connected between respective one ends, a third link in which one end is rotatably connected to a rotatably connected point between the first link and the second link and the other end is guided along a vertical line, and a fourth link in which one end is rotatably connected to the other end of the third link, the other end of the first link is rotatably connected to the slide, the other end of the second link is rotatably connected to the crown, the toggle driving mechanism has a direct acting portion linearly reciprocating in a horizontal direction, the direct acting portion is rotatably connected to the other end of the fourth link, and the third link and the fourth link are operated in such a manner that the first link and the second link bend and stretch working with the linear reciprocation of the direct acting portion.

As mentioned above, the three-stage toggle can be structured by connecting the first to fourth links.

Further, since the first link and the second link are connected to the direct acting portion of the toggle driving mechanism via the third link and the fourth link, it is possible to arrange the direct acting portion in an upper side in comparison with the case of the one-stage toggle (the case of Japanese Unexamined Patent Publication No. 2002-103089). Further, since it is possible to arrange the direct acting portion in the upper side, an interference with the direct acting portion is not generated even if the slide is moved up.

Further, since the first link and the second link are operated so as to be closed, and the third link and the fourth link are operated in such a manner that the rotatably connected point between the third link and the fourth link moves upward, in accordance with the ascent of the slide, the interference between the slide, and the third link and the fourth link is not generated. Accordingly, it is not necessary to interpose the plunger between the toggle mechanism and the slider.

Further, in the servo press in accordance with the present invention, since the direct acting portion is not moved in the vertical direction, but the direct acting portion is arranged so as to reciprocate in the horizontal direction, it is possible to suppress a total height of the apparatus while securing a fixed stroke or more.

(3) Further, in the servo press of the item (2) mentioned above, the toggle driving mechanism has a feed screw mechanism constituted by a feed screw shaft and a nut member engaging with the feed screw shaft, and the nut member constructs the direct acting portion.

As mentioned above, since the feed screw mechanism is employed, it is possible to freely change a reduction ratio by changing an outer diameter and a lead of the feed screw shaft without changing the stroke length.

(4) Further, in the servo press of the item (2) mentioned above, the servo press is provided with a pair of the multi-toggle mechanisms and a pair of the toggle driving mechanisms in line symmetry with respect to a vertical line, one ends of respective fourth link of the pair of the multi-toggle mechanisms are rotatably connected to each other, and the respective toggle driving mechanisms in one and the other of the multi-toggle mechanisms are operated such that the respective direct acting portions thereof come close to or away from each other.

As mentioned above, since the slide is supported by a plurality of connecting points by setting a plurality of multi-toggle mechanisms and toggle driving mechanisms in the line symmetric manner with respect to the vertical line, a capability with respect to an eccentric load is increased.

Further, since one ends of the fourth links are rotatably connected to each other, it is possible to guide the other end of the third link along the vertical line while mutually supporting the load in the horizontal direction applied to the rotatably connected point between the third link and the fourth link.

Accordingly, it is possible to omit "vertical guide member 34" in the other embodiment mentioned below.

(5) Further, in the servo press of the item (3) mentioned above, a pair of toggle driving mechanisms form a feed screw the pair of toggle driving mechanisms comprise a feed screw mechanism constituted by a common feed screw shaft having a right handed screw portion provided to one side in a horizontal direction and a left handed screw portion provided to the other side in the horizontal, and a pair of nut members respectively engaged with the right handed screw portion and the left handed screw portion.

As mentioned above, since the feed screw mechanism is employed, it is possible to freely change the reduction ratio by changing the outer diameter and the lead of the feed screw shaft without changing the stroke length.

Further, since one of the nut members constructs the direct acting portion of one of the toggle driving mechanisms, and the other of the nut members constructs the direct acting portion of the other of the toggle driving mechanisms, it is possible to move the respective direct acting portions symmetrically at the same speed without synchronously controlling by setting the outer diameters and the leads of the right handed screw portion and the left handed screw portion equal. Accordingly, a motion control is easily executed.

(6) Further, in the servo press of the item (2) mentioned above, the servo press is provided with the servo press is provided with a pair of the multi-toggle mechanisms and a pair of the toggle driving mechanisms in line symmetry with respect to a vertical line, the pair of toggle driving mechanisms comprise a feed screw mechanism constituted by a common feed screw shaft having a right handed screw portion provided to one side in a horizontal direction and a left handed screw portion provided to the other side in the horizontal, and a pair of nut members respectively engaged with the right handed screw portion and the left handed screw portion, one of the nut members constructs the direct acting portion of one of the toggle driving mechanisms, and the other of the nut members constructs the direct acting portion of the other of the toggle driving mechanisms, and the pair of nut members come close to or away from each other by the rotation of the feed screw shaft.

As mentioned above, since the slide is supported by a plurality of connecting points by providing a plurality of multi-toggle mechanisms and a plurality of toggle driving mechanisms, a capability with respect to an eccentric load is increased.

Further, since the feed screw mechanism is employed, it is possible to freely change the reduction ratio by changing the outer diameter and the lead of the feed screw shaft without changing the stroke length.

Further, since a pair of nut members constructing one and the other direct acting portions are engaged with one feed screw shaft, it is possible to move the respective direct acting portions symmetrically at the same speed without synchronously controlling by setting the outer diameters and the leads of the right handed screw portion and the left handed screw portion equal. Accordingly, a motion control is easily executed.

(7) Further, in the servo press of the item (5) mentioned above, the servo press is provided with a plurality of servo motors rotationally driving the feed screw shaft.

As mentioned above, since the toggle driving mechanism is provided with a plurality of servo motors rotationally driving the feed screw shaft, it is possible to rotationally drive the feed screw shaft by the other remaining servo motor even if any servo motor continue gets out of order during the operation of the servo press, whereby it is possible to continue the operation. Accordingly, it is possible to prevent an accident causing an operation stop.

(8) Further, in accordance with the present invention, there is provided an operating method of the servo press as described in the item (1) mentioned above, comprising a step of adjusting and setting a stroke of the slide in such a manner as to secure a necessary forming force for pressing a worked subject, and a step of pressing the worked subject at the stroke.

As mentioned above, since the servo press in accordance with the present invention can obtain the higher speed in the moving section of the slide, and obtain the higher pressure in the pressurizing section near the bottom dead point, by employing the three-stage toggle, it is possible to achieve an excellent capability in a punching work.

In this case, when defining the stroke from the bottom dead point in the case of executing the work having a long pressurizing section such as a drawing work by the servo press having the three-stage toggle, in order to secure a pressing force over a whole of the pressurizing section, a large capacity motor is normally necessary. This is because the pressure is low while being at the high speed in the upper section than the portion near the bottom dead point in the three-stage toggle.

Accordingly, in the operating method of the servo press in accordance with the present invention, the stroke is controlled and adjusted in such a manner as to secure the necessary forming force for pressing the worked subject, and the pressing of the worked subject at the stroke is executed. Accordingly, it is possible to execute the pressing widely from the punching work to the drawing work without enlarging the motor capacity. In other words, in accordance with the operating method of the present invention, since it is possible to adjust the stroke continuously, it is possible to obtain the highest productivity at a certain motor capacity by adjusting such a stroke that the necessary forming force can be obtained.

In accordance with the servo motor of the present invention, it is possible to obtain the higher speed in the moving section of the slide, and obtain the higher pressure in the pressurizing section without enlarging the motor capacity. Further, it is not necessary to interpose the plunger between the toggle mechanism and the slide. Further, it is possible to suppress the total height of the apparatus.

In accordance with the operating method of the servo press of the present invention, it is possible to execute the pressing widely from the punching work to the drawing work without enlarging the motor capacity by selecting the suitable stroke in correspondence to the kind of the work.

Thus, in accordance with a non-limiting, illustrative first embodiment, in accordance with the present invention, a servo press is provided that includes (a) a multi-toggle mechanism moving up and down a slide in which an upper die is to be fixed to a lower surface thereof; and (b) a toggle driving mechanism provided on a crown located to an upper side of the slide and driving the multi-toggle mechanism, wherein the multi-toggle mechanism is structured such as to include three or more toggles generating a force amplifying effect by a plurality of links. In accordance with a second non-limiting, illustrative embodiment, in accordance with the present invention, the first non-limiting embodiment is modified so that the multi-toggle mechanism has a first link and a second link rotatably connected between respective one ends, a third link in which one end is rotatably connected to a rotatably connected point between the first link and the second link and the other end is guided along a vertical line, and a fourth link in which one end is rotatably connected to the other end of the third link, the other end of the first link is rotatably connected to the slide, and the other end of the second link is rotatably connected to the crown, wherein the toggle driving mechanism has a direct acting portion linearly reciprocating in a horizontal direction, and the direct acting portion is rotatably connected to the other end of the fourth link, and wherein the third link and the fourth link are operated in such a manner that the first link and the second link bend and stretch working with the linear reciprocation of the direct acting portion. In accordance with a third non-limiting, illustrative embodiment of the present invention, the second non-limiting embodiment is further modified so that the toggle driving mechanism is constituted by a feed screw mechanism having a feed screw shaft and a nut member engaging with the feed screw shaft, and the nut member constructs the direct acting portion.

In accordance with a fourth non-limiting, illustrative embodiment of the present invention, the second non-limiting embodiment is further modified so that the servo press is provided with a pair of the multi-toggle mechanisms and a pair of the toggle driving mechanisms in line symmetry with respect to a vertical line, wherein one ends of the respective fourth link of the pair of the multi-toggle mechanisms are rotatably connected to each other, and wherein the respective toggle driving mechanisms in one and the other of the multi-toggle mechanisms are operated such that the respective direct acting portions thereof come close to or away from each other. In accordance with a fifth non-limiting, illustrative embodiment of the present invention, the fourth non-limiting embodiment is further modified so that the pair of toggle driving mechanisms comprise a feed screw mechanism constituted by a common feed screw shaft having a right handed screw portion provided to one side in a horizontal direction and a left handed screw portion provided to the other side in the horizontal, and a pair of nut members respectively engaged with the right handed screw portion and the left handed screw portion, and wherein one of the nut members constructs the direct acting portion of one of the toggle driving mechanisms, and the other of the nut members constructs the direct acting portion of the other of the toggle driving mechanisms.

In accordance with a sixth non-limiting, illustrate embodiment of the present invention, the second non-limiting embodiment is further modified so that the servo press is provided with a pair of the multi-toggle mechanisms and a pair of the toggle driving mechanisms in line symmetry with respect to a vertical line, wherein the pair of toggle driving mechanisms comprise a feed screw mechanism constituted by a common feed screw shaft having a right handed screw portion provided to one side in a horizontal direction and a left handed screw portion provided to the other side in the horizontal, and a pair of nut members respectively engaged with the right handed screw portion and the left handed screw portion, and wherein one of the nut members constructs the direct acting portion of one of the toggle driving mechanisms, and the other of the nut members constructs the direct acting portion of the other of the toggle driving mechanisms, and the pair of nut members come close to or away from each other by the rotation of the feed screw shaft. In accordance with a seventh non-limiting, illustrative embodiment of the present invention, the fifth non-limiting embodiment is further modified so that the servo press is provided with a plurality of servo motors rotationally driving the feed screw shaft. In accordance with an eighth non-limiting, illustrative embodiment of the present invention, an operating method is provided for the servo press according to the first non-limiting embodiment of the present invention, wherein the method includes a step of adjusting and setting a stroke of the slide in such a manner as to secure a necessary forming force for pressing a worked subject, and a step of pressing the worked subject at the stroke.

DESCRIPTION OF THE PREFERRED EMBODIMENTS

Figure 1:
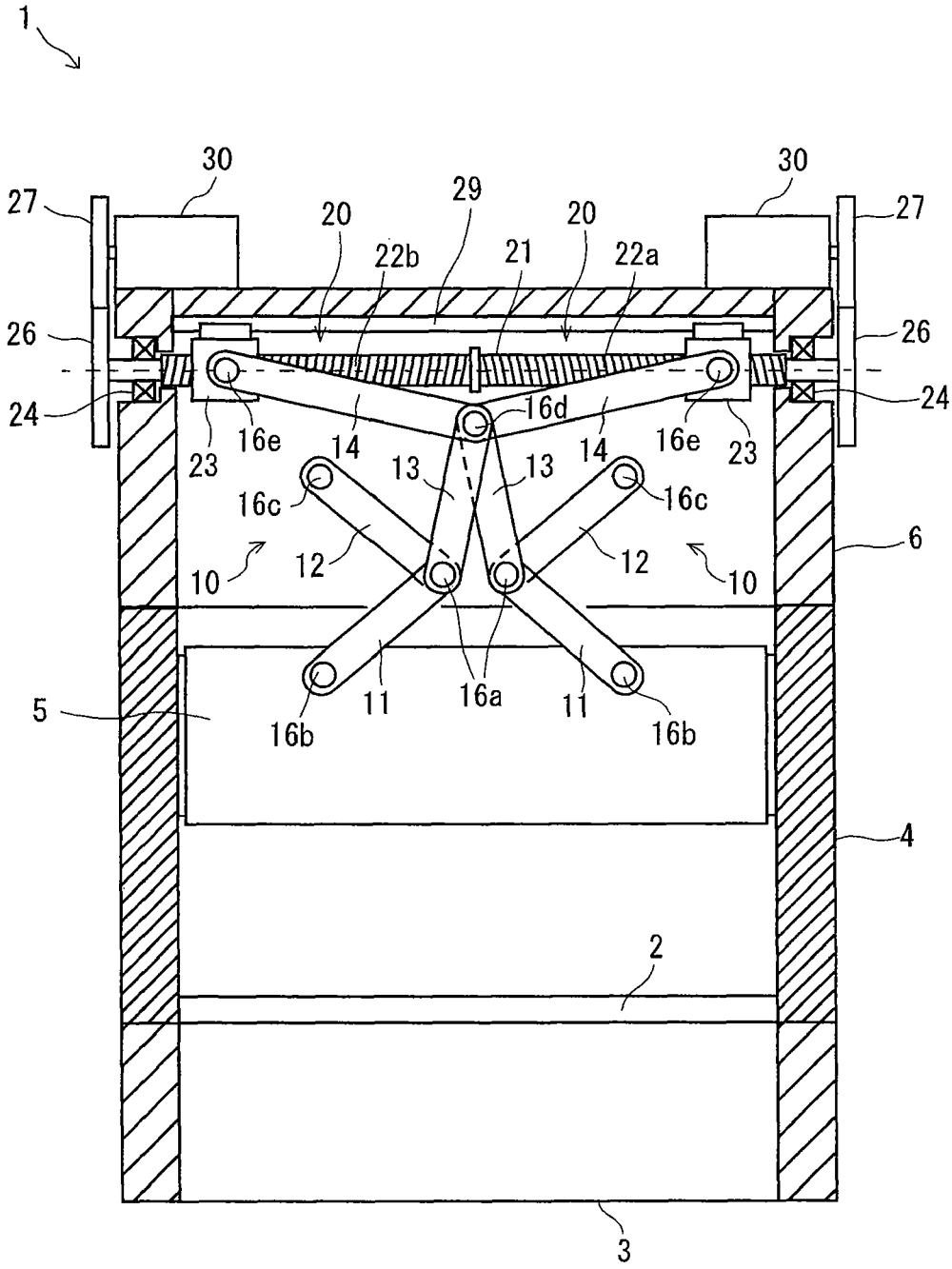
FIG. 1 is a view showing a structure of a servo press in accordance with a first embodiment of the present invention, in which a slide exists at a top dead point position.

A description will be in detail given below of preferable embodiments in accordance with the present invention with reference to the accompanying drawings. In this case, the same reference numerals are attached to the portions that are common in the drawings, and an overlapping description will be omitted.

First Embodiment

Figure 2:
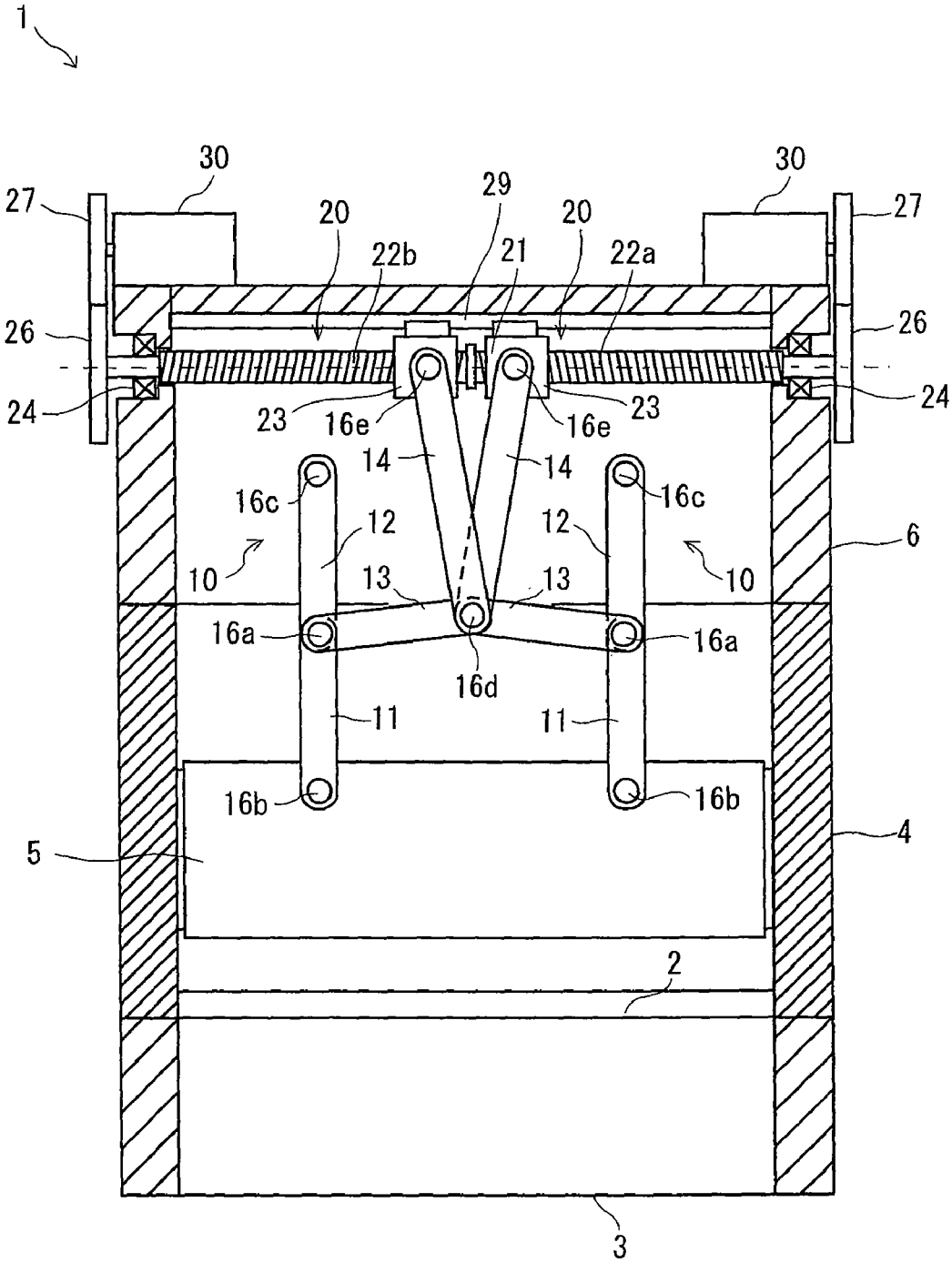
FIG. 2 is a view showing the structure of the servo press in accordance with the first embodiment of the present invention, in which the slide exists at a bottom dead point position.
Figure 3:
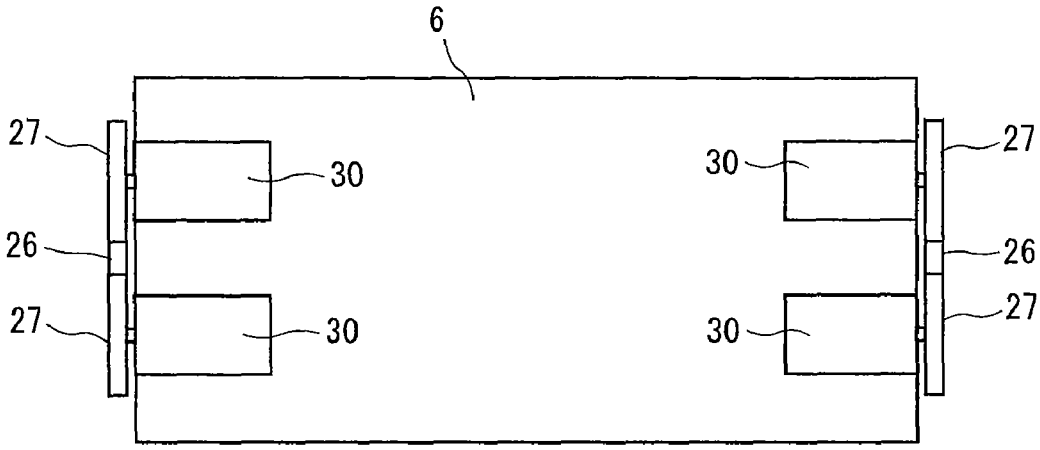
FIG. 3 is a plan view of the servo press in FIG. 1.

FIGS. 1 and 2 are views showing a structure of a servo press 1 in accordance with a first embodiment of the present invention. FIG. 1 shows a state in which a slide 5 exists at a top dead point position, and FIG. 2 shows a state in which the slide 5 exists at a bottom dead point position. FIG. 3 is a plan view of the servo press 1 in FIG. 1.

In FIG. 1, in the servo press 1, a column 4 (also called as an upright) is provided in a rising manner on a bed 3 in which a bolster 2 is fixed to an upper portion, and a crown 6 is provided on the column 4. The slide 5 is supported to the column 4 so as to be slidable up and downs. A lower die (not shown) is to be fixed to an upper surface of the bolster 2, and an upper die (not shown) is to be fixed to a lower surface of the slide 5.

Further, the servo press 1 is provided with a multi-toggle mechanism 10 that moves the slide 5 up and down, a toggle driving mechanism 20 driving the multi-toggle mechanism 10, and a servo motor 30 driving the toggle driving mechanism 20.

The multi-toggle mechanism 10 is structured such that three toggles generating an amplifying effect of a force are provided by a plurality of links (a first link 11 to a fourth link 14). In other words, the multi-toggle mechanism 10 in the servo press 1 is constituted by a three-stage toggle in which a three-stage toggle effect can be obtained.

The servo press 1 in accordance with the present embodiment is provided with a pair of multi-toggle mechanisms 10 in line symmetry with respect to a vertical line. Further, the servo press 1 is provided with a pair of toggle driving mechanisms 20 in line symmetry with respect to the vertical line.

Each of the multi-toggle mechanisms 10 is constituted by the first to fourth links. The first links 11, the second links 12, the third links 13 and the fourth links 14 have the same lengths respectively, in each of the multi-toggle mechanisms 10.

In FIG. 1, the first link 11 and the second link 12 are rotatably connected to each other via a connecting pin 16*a* in respective one ends (an upper end of the first link 11 and a lower end of the second link 12). The other end (a lower end) of the first link 11 is rotatably connected to the slide 5 via a connecting pin 16*b*. The other end (an upper end) of the second link 12 is rotatably connected to the crown 6 via a connecting pin 16*c*. The first link 11 and the second link 12 construct a first toggle generating an amplifying effect of a force.

In this case, in the present application, "toggle" means a mechanism which is constituted by a pair of links having a connected point connected by a pin, and applies an amplified force to a portion between the other ends of a pair of links by applying a force to the connected point so as to move a pair of links close to a straight line. Further, the amplifying effect generated by the toggle is simply called as "amplifying effect of force" in the present application.

One end of the third link 13 is rotatably connected to a rotatably connected point between the first link 11 and the second link 12 via the connecting pin 16*a*. The other end of the third link 13 is rotatably connected to one end of the fourth link 14 via a connecting pin 16*d*. Further, the respective fourth links 14 in the multi-toggle mechanisms 10 in one side and the other side are rotatably connected between their one ends via the connecting pin 16*d*.

In accordance with this structure, it is possible to guide the other end of the third link 13 along a vertical line while supporting a load in a horizontal direction applied to the rotatably connected point between the third link 13 and the fourth link 14, without using any special member. Further, a pair of right and left third links 13 construct a second toggle generating an amplifying effect of the force.

The other end of the fourth link 14 is rotatably connected to a direct acting portion of a slide driving mechanism via a connecting pin 16*e*.

The toggle driving mechanism 20 has a direct acting portion linearly reciprocating in a horizontal direction, the direct acting portion is constituted by a nut member 23 mentioned below, and the nut member 23 is supported by a guide member 29 provided in the crown 6 so as to be slidable in the horizontal direction.

Accordingly, each of the fourth links 14 constructs a third toggle generating an amplifying effect of the force.

In the multi-toggle mechanism 10 structured as mentioned above, the third link 13 and the fourth link 14 are operated in such a manner that the first link 11 and the second link 12 bend and stretch working with a linear reciprocating motion of the direct acting portion (the nut member 23) of the toggle driving mechanism 20.

The toggle driving mechanism 20 has the direct acting portion linearly reciprocating in the horizontal direction as mentioned above, and is installed in an upper side of the second link 12 in the present embodiment.

In the present embodiment, a pair of toggle driving mechanisms 20 is a feed screw mechanism constituted by a common feed screw shaft 21 having a right handed screw portion 22*a* provided to one side in a horizontal direction and a left handed screw portion 22*b* provided to the other side in the horizontal, and a pair of nut members 23 respectively engaged with the right handed screw portion 22*a* and the left handed screw portion 22*b*.

In the present embodiment, one of the nut members 23 constructs the direct acting portion of one of the toggle driving mechanisms 20, and the other of the nut members 23 constructs the other of the toggle driving mechanisms 20.

The feed screw shaft 21 is supported so as to be rotatable around a horizontal axis by a bearing 24 built in the crown 6. A large gear 26 is fixed to both end portions of the feed screw shaft 21. A plurality of (four in the present embodiment, refer to FIG. 3) servo motors 30 rotationally driving the feed screw shaft 21 are installed in an upper portion of the crown 6. A small gear 27 engaging with the large gear 26 is fixed to an output shaft of the servo motor 30. A driving force of the servo motor 30 is transmitted to the feed screw shaft 21 via the small gear 27 and the large gear 26.

In this case, the power transmitting mechanism interposed between the servo motor 30 and the toggle driving mechanism 20 is not limited to the gear transmitting mechanism as mentioned above, but may be constituted by the other mechanisms such as a belt transmitting mechanism, a chain transmitting mechanism and the like.

A pair of nut members 23 are supported by a guide member 29 provided in the crown 6 so as to be slidable in the horizontal direction. The guide member 29 is structured such as to support a load in a vertical direction applied to the nut member 23 at a time of executing a pressing.

The toggle driving mechanism 20 structured as mentioned above is structured such that if the feed screw shaft 21 is rotationally driven in one direction by the servo motor 30, a pair of nut members 23 come close to each other. Further, if the feed screw shaft 21 is rotationally driven in an inverse direction, a pair of nut members 23 move away from each other. In other words, one toggle driving mechanism 20 and the other toggle driving mechanism 20 are operated such that the respective direct acting portions (the nut members 23) move close to and away from each other.

Next, a description will be given of an operation of the servo press 1 in accordance with the present embodiment.

If the feed screw shaft 21 is rotationally driven in one direction by the servo motor 30 from the state shown in FIG. 1, a pair of nut members 23 are operated in a direction of coming close to each other. Accordingly, the third link 13 and the fourth link 14 are tilted, and an "L-shaped portion" constituted by the first link 11 and the second link 12 is expanded, whereby the slide 5 is moved down. Accordingly, a state in FIG. 2 is obtained.

On the contrary, if the feed screw shaft 21 is rotated in an inverse direction by the servo motor 30, a pair of nut members 23 are operated in a direction of moving away from each other. Accordingly, the third link 13 and the fourth link 14 are rotated, and the "L-shaped portion" constituted by the first link 11 and the second link 12 is contracted, whereby the slide 5 is moved up. Accordingly, a state in FIG. 1 is obtained.

Next, a description will be given of a characteristic of a three-stage toggle.

Figure 4:
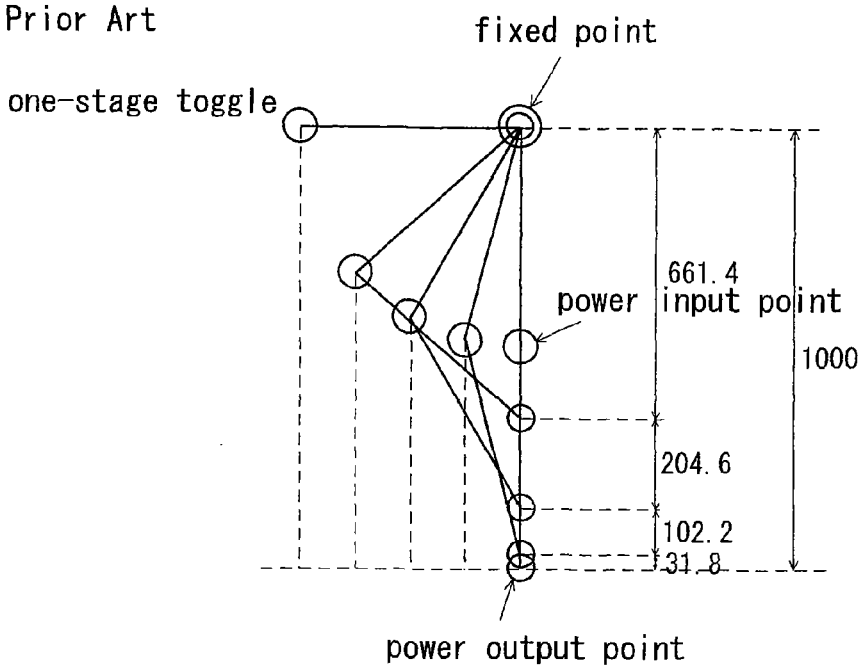
Fig. 4 Prior Art
FIG. 4 is a view showing a behavior of a conventional one-stage toggle.
Figure 5:
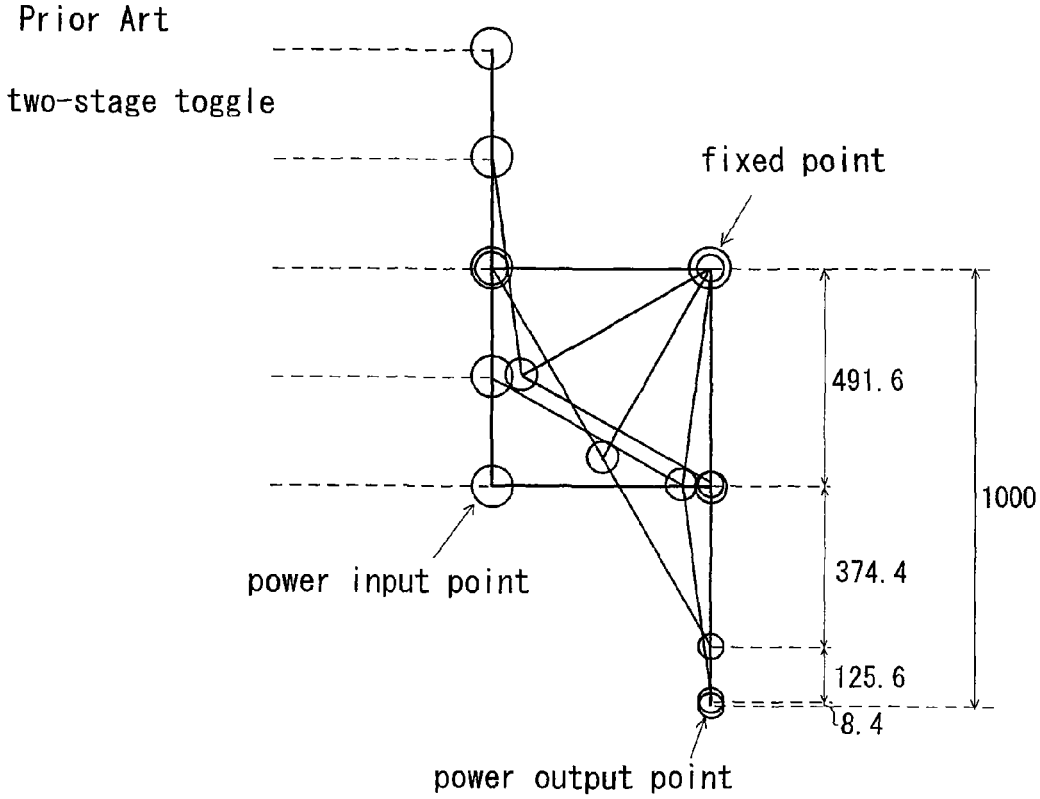
Fig. 5 Prior Art
FIG. 5 is a view showing a behavior of a conventional two-stage toggle.
Figure 6:
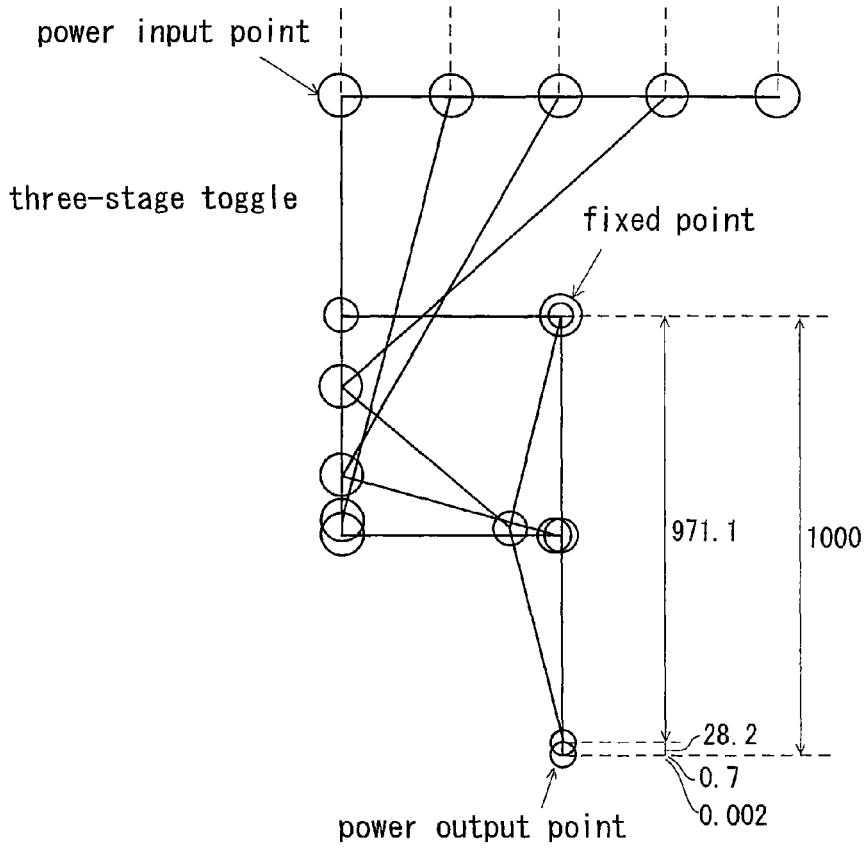
FIG. 6 is a view showing a behavior of a three-stage toggle.

FIGS. 4 to 6 schematically show a behavior of the one-stage toggle, the two-stage toggle and the three-stage toggle. In these structures, under a common condition that the lengths of two links constituting the final stage toggle are both 500 mm, and a stroke of a power output point is 1000 mm, the length of the other link and a stroke of a power input point are decided to a round length in such a manner that the final stage toggle can be operated at a full stroke. Hereinafter, the stroke of the power input point is called as an input stroke, and the stroke of the power output point is called as an output stroke.

In this case, although the length of the input stroke is different in the toggles in the drawings, however, it is possible to design an input rotation and an input torque of the motor equally by adjusting a reduction ratio (a reduction ratio of a speed reduction gear or a lead of a feed screw shaft in the case of the feed screw mechanism). Accordingly, even if they are different, an essence of discussion is not affected.

The input stroke decided as mentioned above is equally divided into four sections, and respective sections of the output stroke corresponding to the respective sections of the input stroke equally divided into four sections as mentioned above in the case of moving the power input point in such a manner that the power output point moves from the bottom dead point to the top dead point are set to a first section, a second section, a third section and a fourth section alphabetically from the bottom dead point side. A moving amount between the first to fourth sections is shown in Table 1. In this case, a unit of the moving amount is mm.

Figure 7:
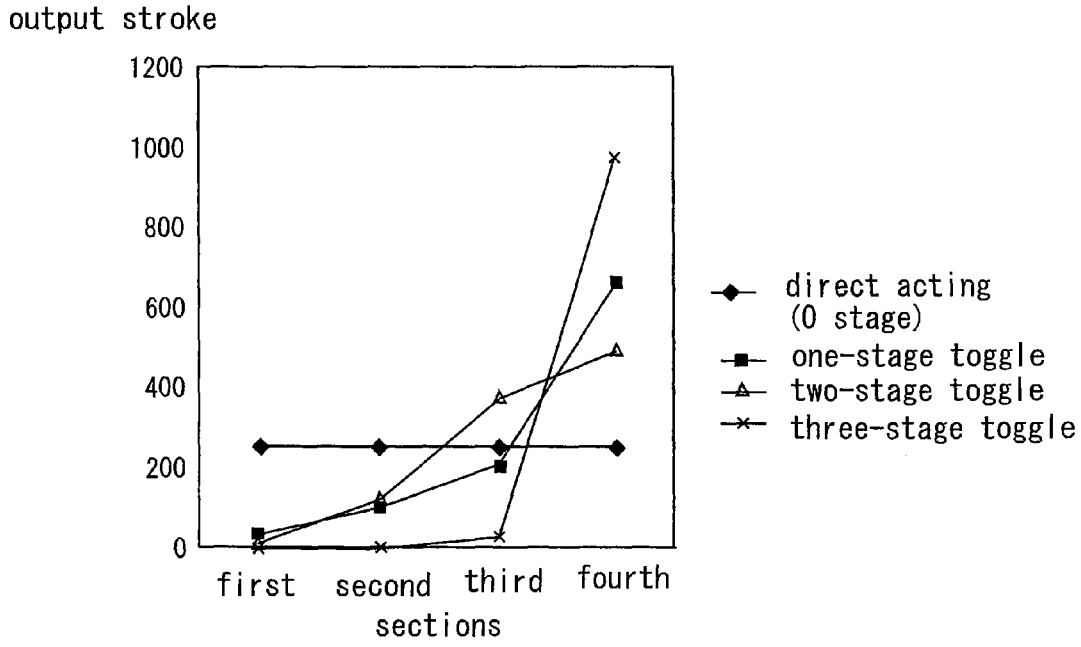
FIG. 7 is a view showing an output stroke per sections of each of the toggles.

Further, FIG. 7 shows a graph showing Table 1. In this case, in Table 1 and FIG. 7, "direct acting (0 stage)" means a drive system in which a linear motion taken out from the servo motor 30 is set as the output stroke as it is.

TABLE 1

| | first section | second section | third section | fourth section |
|---|---|---|---|---|
| direct acting (0 stage) | 250 | 250 | 250 | 250 |
| one-stage toggle | 31.8 | 102.2 | 204.6 | 661.4 |
| two-stage toggle | 8.4 | 125.6 | 374.4 | 491.6 |
| three-stage toggle | 0.002 | 0.7 | 28.2 | 971.1 |

FIG. 7 is a view showing the output stroke per the sections of each of the toggles.

In each of the toggles in FIGS. 4 to 6, in the case that a work load (a motor work load) of the power input point is equal, the moving amount of the power output point in each of the sections is changed as shown in FIG. 7.

Figure 8:
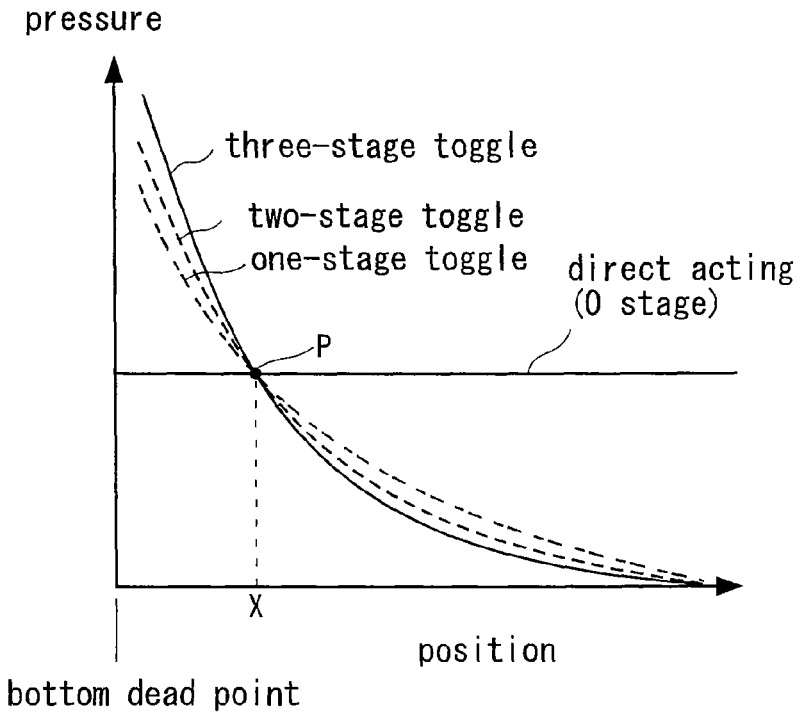
FIG. 8 is a view showing a relation between a position and a pressure of each of the toggles.
Figure 9:
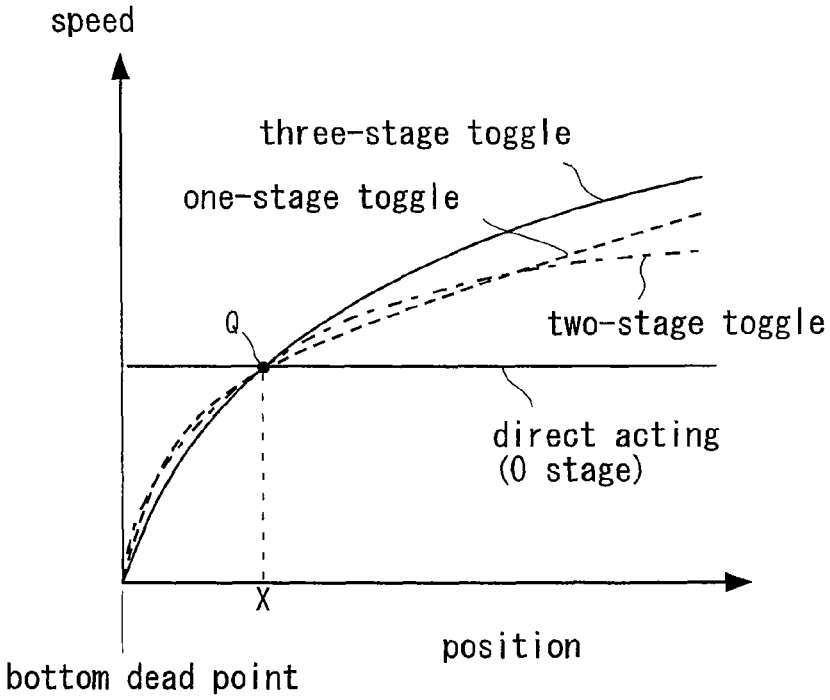
FIG. 9 is a view showing a relation between the position and a speed of each of the toggles.

According to a relation between a position of the power output point, and a pressure and a speed in each of the toggles by a result in FIG. 7, the result is approximately as shown FIGS. 8 and 9. FIG. 8 is a view showing a relation between the position of each of the toggles and the pressure. FIG. 9 is a view showing a relation between the position of each of the toggles and the speed.

On the basis of FIGS. 8 and 9, it is known that the moving speed (that is, the sliding speed) of the power output point closer to the top dead point is higher than the portion near the bottom dead point, and lower speed and higher pressure are achieved near the bottom dead point than the portion near the bottom dead point, in the three-stage toggle in accordance with the present invention in comparison with the conventional one-stage toggle and two-stage toggle. In this case, FIGS. 8 and 9 are prepared on the assumption that the motor work load is the same at a certain position X, and each of lines intersects at a point P and a point Q in each of the toggles.

Next, a description will be given of operations and effects of the servo press 1 in accordance with the present embodiment.

In accordance with the present embodiment, the sliding speed in the side closer to the top dead point is higher than the portion near the bottom dead point, and lower speed and higher pressure are achieved near the bottom dead point than the portion near the bottom dead point, in comparison with the conventional one-stage toggle and two-stage toggle.

Accordingly, it is possible to achieve the higher speed in the moving section of the slide, and achieve the higher pressure in the pressurizing section near the bottom dead point, without enlarging the motor capacity, thereby preventing the enlargement in size of the motor and the cost increase from being caused. Alternatively, since it is possible to make the motor capacity small in the case of maintaining the same pressure as the conventional one, it is possible to achieve the downsizing of the motor and the cost reduction.

In accordance with the present embodiment, since the first link 11 and the second link 12 is connected to the direct acting portion (the nut member 23) of the toggle driving mechanism 20 via the third link 13 and the fourth link 14, it is possible to arrange the direct acting portion in the upper side in comparison with the case of the one-stage toggle. Further, since it is possible to arrange the direct acting portion in the upper side, the interference with the direct acting portion is not generated even if the slide 5 is moved up.

Further, since the first link 11 and the second link 12 are operated so as to be closed, and the third link 13 and the fourth link 14 are operated in such a manner that the rotatably connected point between the third link 13 and the fourth link 14 is moved to the upper side, in accordance with the ascent of the slide 5, the interference between the slide 5, and the third link 13 and the fourth link 14 is not generated. Accordingly, it is not necessary to interpose the plunger between the multi-toggle mechanism 10 and the slider 5.

Further, since the direct acting portion does not move in the vertical direction, and the direct acting portion is arranged so as to linearly reciprocate in the horizontal direction, it is possible to suppress the total height of the apparatus while securing the fixed stroke or more.

In accordance with the present embodiment, since the feed screw mechanism is employed as the toggle driving mechanism 20, it is possible to freely change the reduction ratio by changing the outer diameter and the lead of the feed screw shaft 21 without changing the stroke length.

In accordance with the present embodiment, since the slide 5 is supported by a plurality of connecting points by providing a plurality of multi-toggle mechanisms 10 and a plurality of toggle driving mechanisms 20, a capability with respect to the eccentric load is increased.

Further, since one ends of the respective fourth links 14 are rotatably connected to each other, it is possible to omit the support means for supporting the load in the horizontal direction applied to the rotatably connected point (the connecting pin 16*d*) between the third link 13 and the fourth link 14 in one side and the other side.

In accordance with the present embodiment, since a pair of nut members 23 corresponding to the direct acting portions in one side and the other side are engaged with one feed screw shaft 21, it is possible to move each of the direct acting portions synchronously at the same speed without synchronously controlling, by making the outer diameters and the leads of the right handed screw portion 22*a* and the left handed screw portion 22*b* equal. Accordingly, it is easy to control the operation.

In accordance with the present embodiment, since the toggle driving mechanism 20 is provided with a plurality of servo motors 30 rotationally driving the feed screw shaft 21, it is possible to rotationally drive the feed screw shaft 21 by the other remaining servo motor 30 even in the case that any servo motor 20 gets out of order during the operation of the servo press 1, and it is possible to continue the operation. Accordingly, it is possible to prevent an accident causing an operation stop.

Second Embodiment

Figure 10:
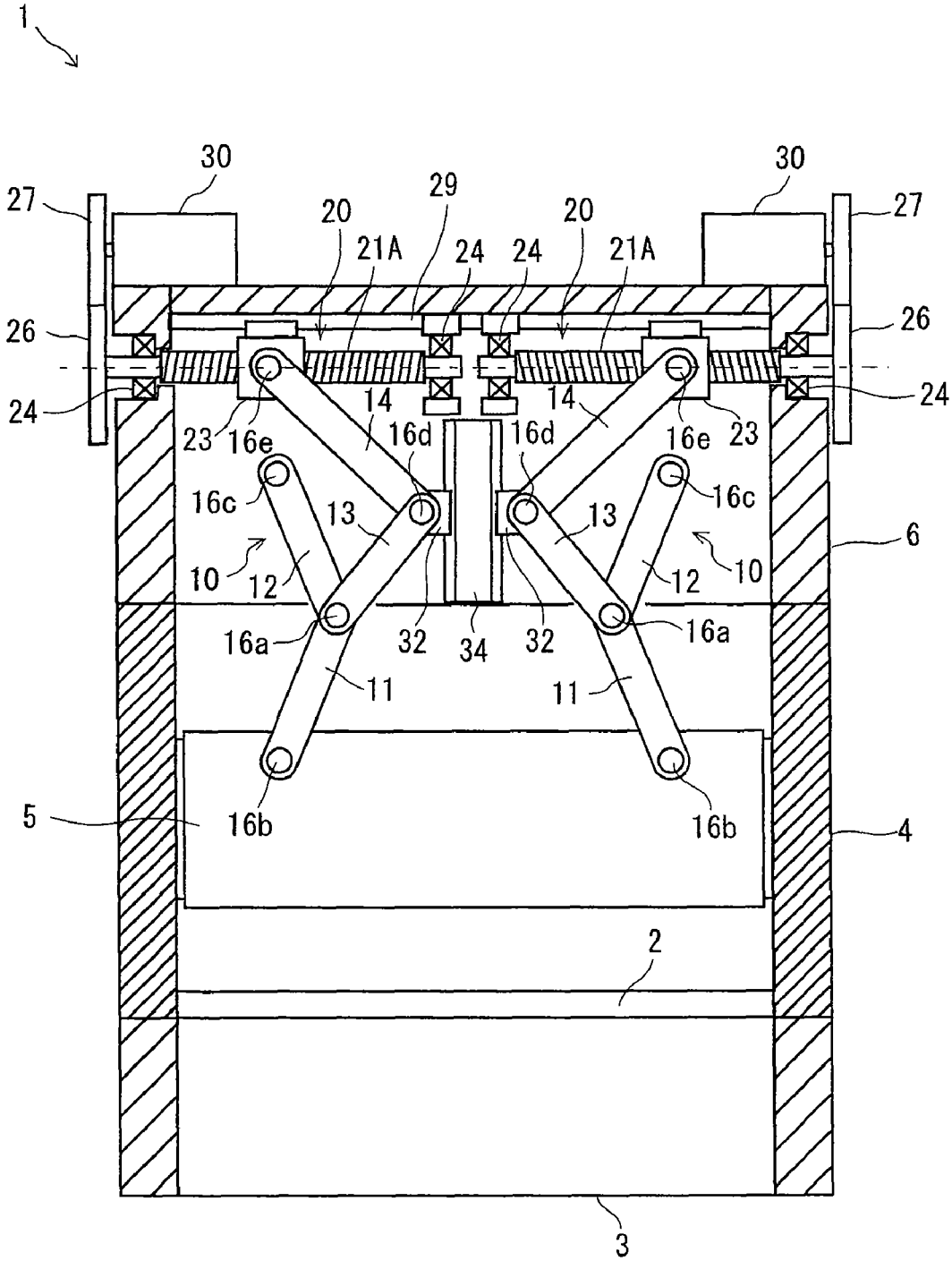
FIG. 10 is a view showing a structure of a servo press in accordance with a second embodiment of the present invention.

FIG. 10 is a view showing a structure of a servo press 1 in accordance with a second embodiment of the present invention.

The servo press 1 in accordance with the present embodiment is provided with a pair of multi-toggle mechanisms 10 which are symmetric in the drawing, and a pair of toggle driving mechanisms 20 which are symmetric in the drawing, in the same manner as the first embodiment.

In the first embodiment mentioned above, the feed screw shaft 21 with which the nut member 23 is engaged is constituted by one common screw shaft, however, in the present embodiment, each of the nut members 23 is engaged with each of independent feed screw shafts 21A. Each of the feed screw shafts 21A is supported by the bearing 24 so as to be rotatable around a horizontal axis.

Further, in the present embodiment, each of the feed screw shafts 21A is rotationally driven by two servo motors 30.

Further, in the first embodiment, one ends of respective fourth link 14 of the pair of the multi-toggle mechanisms 10 are rotatably connected to each other, however, one ends of respective fourth link 14 are separated in the present embodiment. Further, in order to support a load in a horizontal direction applied to the rotatably connected point (the connecting pin 16*d*) between the third link 13 and the fourth link 14, and make the rotatably connected point slidable in the vertical direction, a slider 32 to which the connecting pin 16*d* is fixed, and a vertical guide member 34 supporting the slider 32 so as to be slidable in the vertical direction are installed in the crown 6.

The structure of the other portions of the servo press 1 in accordance with the present embodiment is the same as the first embodiment.

In accordance with the structure of the present embodiment, it is possible to drive each of the multi-toggle mechanisms 10 by rotatably driving each of the feed screw shafts 21A by the servo motor 30, and it is possible to move up and down the slide 5. Since the operation at this time can be easily understood from the description of the first embodiment, a description of details will be omitted.

In the present embodiment, the structure is made such that two sliders 32 slide on both sides of one vertical guide member 34, however, independent vertical guide members may be installed per two sliders 32.

In the present embodiment, the vertical guide member is structured such as to slide the slider in the vertical direction, however, may be structured such as to slide in a direction that is inclined with respect to the vertical direction.

In the present embodiment, the structure is made such that each of the nut members 23 is engaged with the independent feed screw shaft 21A, and the respective fourth links 14 in the multi-toggle mechanisms 10 in one side and the other side are separated, however, in place of this structure, the structure may be made such that the feed screw shaft with which each of the nut members 23 is engaged is constituted by one common screw shaft (that is, the feed screw shaft is the same as the first embodiment) and the respective fourth links 14 in the multi-toggle mechanisms 10 in one side and the other side are separated. Alternatively, the structure may be made such that each of the nut members 23 is engaged with the independent feed screw shaft, and the respective fourth links 14 in the multi-toggle mechanisms 10 in one side and the other side are rotatably connected between one ends (that is, the structure in which one ends of the fourth links 14 are rotatably connected is the same as the first embodiment).

In the present embodiment, a pair of multi-toggle mechanisms 10 and a pair of toggle driving mechanisms 20 are provided, however, in place of this structure, the structure may be made such that one multi-toggle mechanism 10 and one toggle driving mechanism 20 are provided. In other words, it is possible to employ a one-point press in which the multi-toggle mechanism 10 and the slide 5 are connected by one point.

Third Embodiment

A description will be given of an operating method of the servo press 1 in accordance with the embodiment mentioned above in accordance with a third embodiment of the present invention, with reference to FIG. 11.

As mentioned above, since the servo press 1 in accordance with the present invention can obtain the higher speed in the moving section of the slide and the higher pressure in the pressurizing section near the bottom dead point, by employing the three-stage toggle, it is possible to achieve an excellent capability in the punching work.

In this case, when defining the stroke from the bottom dead point in the case of executing the work having a long pressurizing section such as a drawing work by the servo press having the three-stage toggle, in order to secure a pressing force over a whole of the pressurizing section, a large capacity motor is normally necessary. This is because the pressure is low while being at the high speed in the upper section than the portion near the bottom dead point in the three-stage toggle.

Figure 11A:
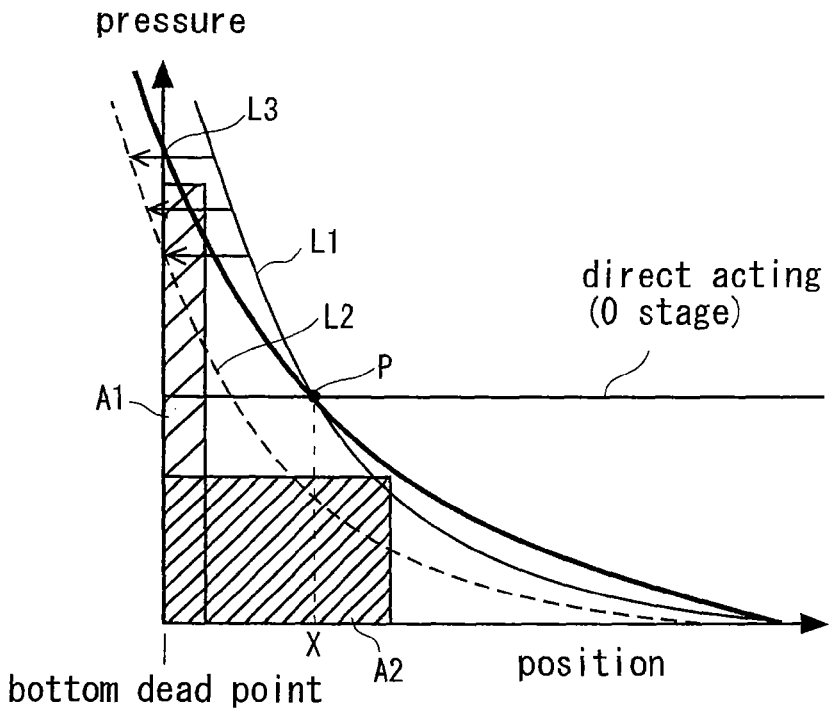
FIG. 11 is a view explaining an operating method of a servo press in accordance with an embodiment of the present invention.

For example, in the case of a three-stage toggle having a pressure curve shown by reference symbol L1 in FIG. 11A, since a range A1 exists in an inner side of the pressure curve L1 with respect to a worked subject (a punched subject or the like) in which a necessary forming force is shown by the range A1, a pressing can be executed.

On the other hand, since a range A2 protrudes from the pressure curve L1 with respect to a worked subject (a drawn subject or the like) in which a necessary forming force is shown by the range A2, a pressing can not be executed.

Accordingly, in accordance with a pressure curve L3, it is possible to press the worked subject in which the forming force in the range A2 is necessary. A designing method of the pressure curve is as follows.

First, a lower limit (a bottom dead point) of the stroke is defined in an upper side than a bottom dead point on an original mechanism, by utilizing a continuous control function of the servo press in which the stroke can be set in an optional range between the bottom dead point and the top dead point of the slide. As a result, the pressure curve L1 is shifted in a leftward direction in FIG. 11A while maintaining its shape, and a pressure curve L2 is obtained. In this state, the pressure in the set stroke becomes lower than the pressure curve L1.

Next, by enlarging the pressure curve L2 at a predetermined magnification passing through an intersecting point P, a pressure curve L3 is obtained.

The pressure curve can be enlarged by changing a gear ratio of the large gear 26 and the small gear 27 between the servo motor 30 and the portion (the feed screw shaft 21 in the embodiment mentioned above) transmitting the power to the multi-toggle mechanism 10 in the toggle driving mechanism 20, in the servo press 1 mentioned above, or interposing a speed reduction gear and adjusting a reduction ratio of the speed reduction gear.

In this case, the intersecting point P has the same meaning as that shown in FIG. 8. Since the pressure curve L3 passes through the intersecting point P, the motor capacity is equal between the pressure curve L3 and the pressure curve L1 even by adjusting the reduction ratio.

In the servo press 1 in accordance with the embodiment mentioned above, it is possible to function as the speed reduction gear by setting the gear ratio of the large gear 26 and the small gear 27. In the case that the other mechanisms (a belt driving mechanism and the like) are employed as the power transmitting mechanism between the servo motor 30 and the toggle driving mechanism 20, it is possible to function as the speed reduction gear in the same manner. Alternatively, it is possible to function the feed screw mechanism itself as the speed reduction gear by adjusting the outer diameters and the leads of the feed screw shafts 21 and 21A. Further, the servo press 1 is provided with a control portion that is programmed so as to regulate to a suitable stroke in correspondence to a kind of the press work.

The pressure curve L3 changed as mentioned above comes to a curve which easily corresponds to the drawing work in comparison with the pressure curve L1, and is weak in the punching work. The work in which the necessary forming force is comparatively small can be processed at the same speed (producing speed) as the one-stage toggle and the two-stage toggle or the like in accordance with the pressure curve mentioned above.

Figure 11B:
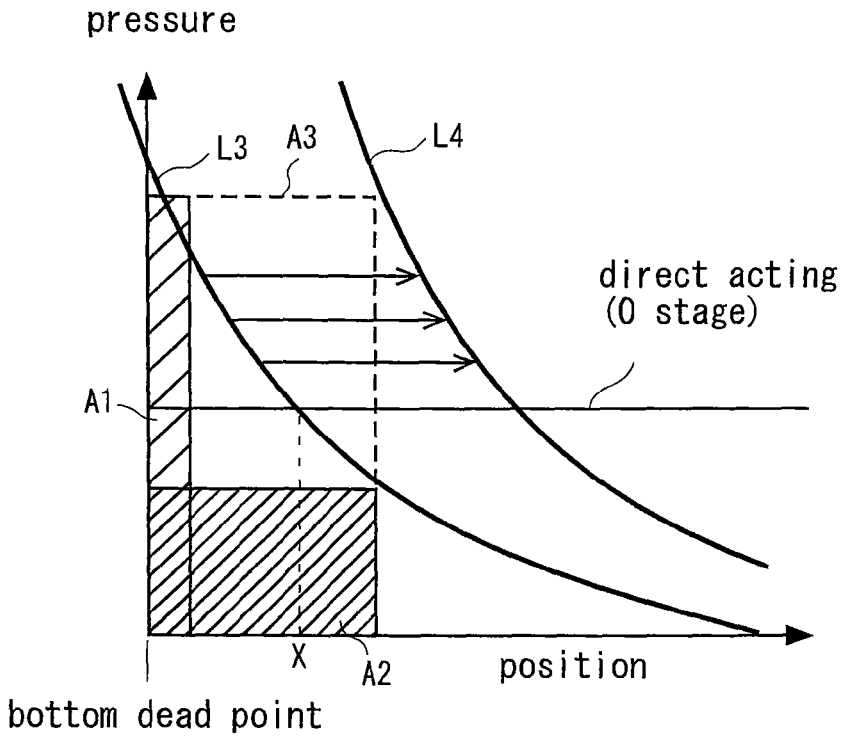

In this case, in the case of aiming at a product class in which the comparatively great forming force is necessary, a greater forming force can be obtained (a pressure curve L4) by changing to the stroke closer to the bottom dead point, as shown in FIG. 11B. As a result, it is possible to press the worked subject to the range A3. In this case, in the case of the pressure curve L4, the producing speed is lowered in comparison with the pressure curve L3, because the region having the slow forming speed is utilized.

As mentioned above, in accordance with the operating method of the servo press in accordance with the present invention, since the stroke is controlled and adjusted in such a manner as to secure the necessary forming force for pressing the worked subject, and executes the pressing of the worked subject at the stroke, it is possible to execute the pressing widely from the punching work to the drawing work without enlarging the motor capacity. In other words, in accordance with the operating method of the present invention, since it is possible to adjust the stroke continuously, it is possible to obtain the highest productivity at a certain motor capacity by setting such a stroke that the necessary forming force can be obtained.

The changing function of the forming force and the producing speed obtained by changing the utilized stroke is not necessarily limited to the three-stage toggle. However, as shown in FIGS. 8 and 9, since the servo press 1 in accordance with the present invention having the three-stage toggle is wider in the forming force from the great region to the small region, and in the speed from the higher region to the lower region, in comparison with the conventional servo press having the one-stage toggle or the two-stage toggle, the following advantages can be obtained. In other words, in accordance with the three-stage toggle, in the case of setting the variable range of the forming force to correspond equal, there is obtained an advantage that the regulated stroke change amount is the smallest. This advantage adapts to the feature of the three-stage toggle, which can suppress the total height of the apparatus while securing the fixed stroke or more.

In this case, the toggle driving mechanism 20 in each of the embodiments mentioned above is constituted by the feed screw mechanism, however, the present invention is not limited to this, but can employ a rack and pinion mechanism, a linear motor and the like as the mechanism having the direct acting portion.

In the description mentioned above, the description is given of the embodiments in accordance with the present invention, however, the embodiments of the present invention disclosed above are given only for exemplification, and the scope of the present invention is not limited to the embodiments of the present invention. The scope of the present invention is indicated by the description of claims, and includes equalizing meanings of claims and all the modifications within the scope.

What is claimed is:

1. A servo press comprising:

(a) a multi-toggle mechanism operable to move a slide up and down, wherein an upper die is to be fixed to a lower surface of the slide, wherein the multi-toggle mechanism includes three or more toggles generating a force amplifying effect by a plurality of links; and (b) a toggle driving mechanism provided on a crown located to an upper side of the slide and driving the multi-toggle mechanism, wherein the plurality of links of the multi-toggle mechanism include a first link and a second link rotatably connected between respective first ends, a third link in which a first end is rotatably connected to a rotatably connected point between the first link and the second link and a second end of the third link is guided along a vertical line, and a fourth link in which a first end is rotatably connected to the second end of the third link, and a second end of the first link is rotatably connected to the slide, and a second end of the second link is rotatably connected to the crown, wherein the toggle driving mechanism has a direct acting portion linearly reciprocating in a horizontal direction, and the direct acting portion is rotatably connected to a second end of the fourth link, and wherein the third link and the fourth link are operated so that the first link and the second link bend and stretch working with the linear reciprocation of the direct acting portion of the toggle driving mechanism.

2. The servo press as claimed in claim 1, wherein the toggle driving mechanism comprises a feed screw mechanism having a feed screw shaft and a nut member engaging with the feed screw shaft, and the nut member is the direct acting portion.

3. A servo press comprising:

a pair of multi-toggle mechanisms and a pair of toggle driving mechanisms in line symmetry with respect to a first vertical line, wherein the pair of multi-toggle mechanisms include a first multi-toggle mechanism and a second multi-toggle mechanism, and the pair of toggle driving mechanisms include a first toggle driving mechanism and a second toggle driving mechanism, wherein the first multi-toggle mechanism is disposed to move a slide up and down, wherein an upper die is to be fixed to a lower surface of the slide, wherein the first multi-toggle mechanism includes three or more toggles generating a force amplifying effect by a first plurality of links, and wherein the first toggle driving mechanism is provided on a crown located to an upper side of the slide and driving the first multi-toggle mechanism, wherein the first plurality of links of the first multi-toggle mechanism include i. a first link and a second link rotatably connected between respective first ends;

ii. a third link in which a first end is rotatably connected to a rotatably connected point between the first link and the second link and a second end of the third link is guided along a second vertical line; and iii. a fourth link in which a first end is rotatably connected to the second end of the third link, and a second end of the first link is rotatably connected to the slide, and a second end of the second link is rotatably connected to the crown, wherein the first toggle driving mechanism has a first direct acting portion linearly reciprocating in a first horizontal direction, and the first direct acting portion is rotatably connected to a second end of the fourth link of the first plurality of links, and wherein the third link and the fourth link of the first plurality of links are operated so that the first link and the second link of the first plurality of links bend and stretch working with the linear reciprocation of the first direct acting portion of the first toggle driving mechanism, and wherein the second multi-toggle mechanism is disposed to move the slide up and down with the first multi-toggle mechanism, wherein the second multi-toggle mechanism includes three or more toggles generating a force amplifying effect by a second plurality of links, and wherein the second toggle driving mechanism is provided on the crown located to the upper side of the slide and driving the second multi-toggle mechanism, wherein the second plurality of links of the second multi-toggle mechanism include i. a fifth link and a sixth link rotatably connected between respective first ends;

ii. a seventh link in which a first end is rotatably connected to a rotatably connected point between the fifth link and the sixth link and a second end of the seventh link is guided along a second vertical line; and iii. an eighth link in which a first end is rotatably connected to the second end of the seventh link, and a second end of the fifth link is rotatably connected to the slide, and a second end of the sixth link is rotatably connected to the crown, wherein the second toggle driving mechanism has a second direct acting portion linearly reciprocating in a second horizontal direction, and the second direct acting portion is rotatably connected to a second end of the eighth link of the second plurality of links, and wherein the seventh link and the eighth link of the second plurality of links are operated so that the fifth link and the sixth link of the second plurality of links bend and stretch working with the linear reciprocation of the second direct acting portion of the second toggle driving mechanism, and wherein the first end of the fourth link of the pair of multi-toggle mechanisms is rotatably connected to the first end of the eighth link, and wherein the first toggle driving mechanism connected to the first plurality of links of the first multi-toggle mechanism and the second toggle driving mechanism connected to the second plurality of links of the second multi-toggle mechanism are operated so that the first direct acting portion and the second direct acting portion come close to or away from each other.

4. The servo press as claimed in claim 3, wherein the pair of toggle driving mechanisms comprise a feed screw mechanism comprising a common feed screw shaft having a right handed screw portion provided to one side in a third horizontal direction and a left handed screw portion provided to the other side in the third horizontal direction, and a pair of nut members respectively engaged with the right handed screw portion and the left handed screw portion, and wherein one of the pair of nut members is the first direct acting portion of the first toggle driving mechanism or the second direct acting portion of the second toggle driving mechanism, and the other one of the pair of nut members is the direct acting portion of the other one of the pair of toggle driving mechanisms.

5. The servo press as claimed in claim 4, wherein the servo press further comprises:

a plurality of servo motors rotationally driving the feed screw shaft.

6. A servo press comprising:

a pair of multi-toggle mechanisms and a pair of toggle driving mechanisms in line symmetry with respect to a first vertical line, wherein the pair of multi-toggle mechanisms include a first multi-toggle mechanism and a second multi-toggle mechanism, and the pair of toggle driving mechanisms include a first toggle driving mechanism and a second toggle driving mechanism, wherein the first multi-toggle mechanism is disposed to move a slide up and down, wherein an upper die is to be fixed to a lower surface of the slide, wherein the first multi-toggle mechanism includes three or more toggles generating a force amplifying effect by a first plurality of links, and wherein the first toggle driving mechanism is provided on a crown located to an upper side of the slide and driving the first multi-toggle mechanism, wherein the first plurality of links of the first multi-toggle mechanism include i. a first link and a second link rotatably connected between respective first ends;

ii. a third link in which a first end is rotatably connected to a rotatably connected point between the first link and the second link and a second end of the third link is guided along a second vertical line; and iii. a fourth link in which a first end is rotatably connected to the second end of the third link, and a second end of the first link is rotatably connected to the slide, and a second end of the second link is rotatably connected to the crown, wherein the first toggle driving mechanism has a first direct acting portion linearly reciprocating in a first horizontal direction, and the first direct acting portion is rotatably connected to a second end of the fourth link of the first plurality of links, and wherein the third link and the fourth link of the first plurality of links are operated so that the first link and the second link of the first plurality of links bend and stretch working with the linear reciprocation of the first direct acting portion of the first toggle driving mechanism, and wherein the second multi-toggle mechanism is disposed to move the slide up and down with the first multi-toggle mechanism, wherein the second multi-toggle mechanism includes three or more toggles generating a force amplifying effect by a second plurality of links, and wherein the second toggle driving mechanism is provided on the crown located to the upper side of the slide and driving the second multi-toggle mechanism, wherein the second plurality of links of the second multi-toggle mechanism include i. a fifth link and a sixth link rotatably connected between respective first ends;

ii. a seventh link in which a first end is rotatably connected to a rotatably connected point between the fifth link and the sixth link and a second end of the seventh link is guided along a second vertical line; and iii. an eighth link in which a first end is rotatably connected to the second end of the seventh link, and a second end of the fifth link is rotatably connected to the slide, and a second end of the sixth link is rotatably connected to the crown, wherein the second toggle driving mechanism has a second direct acting portion linearly reciprocating in a second horizontal direction, and the second direct acting portion is rotatably connected to a second end of the eighth link of the second plurality of links, and wherein the seventh link and the eighth link of the second plurality of links are operated so that the fifth link and the sixth link of the second plurality of links bend and stretch working with the linear reciprocation of the second direct acting portion of the second toggle driving mechanism, and wherein the pair of toggle driving mechanisms comprise a feed screw mechanism comprising a common feed screw shaft having a right handed screw portion provided to one side in a third horizontal direction and a left handed screw portion provided to the other side in a fourth horizontal direction, and a pair of nut members respectively engaged with the right handed screw portion and the left handed screw portion, and wherein one of the pair of nut members is the first direct acting portion of the first toggle driving mechanism or the second direct acting portion of the second toggle driving mechanism, and the other one of the pair of nut members is the direct acting portion of the other one of the pair of toggle driving mechanisms, and the pair of nut members come close to or away from each other by rotation of the feed screw shaft.

* * * * *